US008814618B2

(12) United States Patent
Yoshigasaki et al.

(10) Patent No.: US 8,814,618 B2
(45) Date of Patent: Aug. 26, 2014

(54) OUTBOARD ENGINE UNIT

(75) Inventors: Tsuyoshi Yoshigasaki, Wako (JP); Tomoaki Ishikawa, Wako (JP); Nobuchika Katagiri, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 120 days.

(21) Appl. No.: 13/592,629

(22) Filed: Aug. 23, 2012

(65) Prior Publication Data

US 2013/0052891 A1 Feb. 28, 2013

(30) Foreign Application Priority Data

Aug. 31, 2011 (JP) ..... 2011-189006

(51) Int. Cl.
*B63H 20/20* (2006.01)
*B63H 21/38* (2006.01)

(52) U.S. Cl.
CPC ..... *B63H 21/38* (2013.01); *B63H 20/20* (2013.01)
USPC ..... 440/88 L; 440/83

(58) Field of Classification Search
USPC ..... 440/75, 76, 80, 81, 83, 88 L
See application file for complete search history.

(56) References Cited

U.S. PATENT DOCUMENTS

| | | | | |
|---|---|---|---|---|
| 4,650,430 | A * | 3/1987 | Schiek | 440/88 L |
| 5,236,380 | A * | 8/1993 | Schueller et al. | 440/76 |
| 5,643,025 | A * | 7/1997 | Suzuki | 440/75 |
| 5,697,821 | A * | 12/1997 | Ogino | 440/80 |
| 7,494,391 | B2 * | 2/2009 | Okabe | 440/83 |

FOREIGN PATENT DOCUMENTS

JP 2004-262397 A 9/2004

* cited by examiner

*Primary Examiner* — Lars A Olson
(74) *Attorney, Agent, or Firm* — Westerman, Hattori, Daniels & Adrian, LLP

(57) ABSTRACT

An outboard engine unit, where a drive shaft is connected to an engine and rotatably supported in a drive shaft chamber via a bearing and where a gear mechanism for transmitting rotation of the drive shaft to a propeller shaft is accommodated in a gear chamber, includes: a lubricant circulation section for returning lubricant oil, having lubricated the bearing, back to the gear chamber; an oil storage chamber for receiving the lubricant oil having lubricated the bearing; and a return passage communicating the oil storage chamber with the gear chamber. The lubricant oil guided to the oil storage chamber is returned back to the gear chamber via the return passage.

3 Claims, 12 Drawing Sheets

OUTBOARD ENGINE UNIT

CROSS-REFERENCE TO RELATED APPLICATIONS

The present application claims priority under 35 U.S.C. §119 to Japanese Patent Application No. 2011-189006, filed Aug. 31, 2011, entitled "OUTBOARD ENGINE UNIT". The contents of this application are incorporated herein in their entirety.

TECHNICAL FIELD

The present invention relates to outboard engine units which include a drive shaft connected to an engine and rotatably supported in a drive shaft chamber via a bearing, and in which rotation of the drive shaft is transmitted to a propeller shaft via a gear mechanism.

BACKGROUND OF THE INVENTION

Generally, in outboard engine units, a drive shaft for transmitting rotation of an engine extends vertically, a pair of bevel gears meshingly engage with a pinion (i.e., pinion bevel gear) provided on a lower end portion of the vertical drive shaft, and a propeller shaft is connected to the bevel gears via a clutch (dog clutch). The pinion, the pair of bevel gears and the clutch are accommodated in a gear chamber within a gear case, and the gear chamber is filled with lubricant oil.

A thrusting propeller is mounted on the propeller shaft, and a shift rod is connected to the clutch. The shift rod is accommodated in a shift chamber within the gear case. By the clutch being operated via the shift rod, switching can be made among a forward rotation state in which one of the pair of bevel gears is connected to the propeller shaft, a reverse rotation state in which the other of the pair of bevel gears is connected to the propeller shaft and a neutral state in which the pair of bevel gears are disconnected from the propeller shaft.

Further, the drive shaft is rotatably supported at its support shaft section, located above the pinion, in the gear case by means of a taper roller bearing. The taper roller bearing is provided above the oil level of the lubricant oil filled in the gear case. Thus, a lubrication device is provided for directing the lubricant oil upward to the taper roller bearing. To that end, the lubrication device includes an oil slinger located underneath the taper roller bearing of the drive shaft and communicating with the gear chamber via a supply passage, and the taper roller and the shift chamber are in communication with each other via a return passage. A helical guide groove is formed in the outer periphery of the oil slinger.

One example of such outboard engine units is disclosed in JP-A 2004-262397 (hereinafter referred to as "the relevant patent literature"), according to which rotation of the drive shaft is transmitted to the bevel gears to rotate the bevel gears, so that the lubricant oil of the gear chamber is directed to the oil slinger via the supply passage. The oil slinger rotates together with the drive shaft, and by such rotation of the oil slinger, the lubricant oil directed to the oil slinger is then directed, via the helical guide groove, to the taper roller bearing, so that the taper roller bearing is lubricated with the lubricant oil. The lubricant oil having lubricated the taper roller bearing is then directed to the shift chamber via the return passage. The lubricant oil having been directed to the shift chamber is returned from the shift chamber back to the gear chamber. By circulating the lubricant oil in the aforementioned manner, the taper roller bearing can be lubricated with the lubricant oil.

In order to enhance durability of a power transmission system of the outboard engine unit, particularly the pinion and the pair of bevel gears (hereinafter collectively referred to as "gear mechanism"), increasing the size of the gear mechanism may be a conceivable option. Further, in the outboard engine unit disclosed in the relevant patent literature, the gear mechanism is accommodated in the gear chamber, and thus, if the size of the gear mechanism is increased, an inner space of the gear chamber would be decreased. Hence, as the lubricant oil is circulated to lubricate the taper roller bearing, inner pressure of the gear chamber would increase so that it becomes difficult to retain the lubricant oil within the gear chamber by means of a sealing member.

As a countermeasure against such an inconvenience, it is conceivable to increase the size of the gear case of the outboard engine unit to thereby increase the inner space of the gear case. However, if the size of the gear case is increased like this, resistance of seawater would increase during sliding travel of the hull or body of the watercraft, which would result in a cause of lowered capability (sliding travel capability) of the outboard engine unit.

SUMMARY OF THE INVENTION

An improved outboard engine unit is provided which can achieve an enhanced durability of the power transmission system, particularly the gear mechanism, without increasing the size of the gear case.

The improved outboard engine unit includes a drive shaft connected to a crankshaft of an engine and rotatably supported in a drive shaft chamber via a bearing, and in which a gear mechanism for transmitting rotation of the drive shaft to a propeller shaft is accommodated in a gear chamber. The outboard engine unit further comprises: a circulation section for, through rotation of the gear mechanism, directing lubricant oil of the gear chamber to the bearing and returning the lubricant oil, having lubricated the bearing, back to the gear chamber; an oil storage chamber provided in communication with the circulation section for receiving the lubricant oil having lubricated the bearing; and a return passage communicating the oil storage chamber with the gear chamber, the lubricant oil guided to the oil storage chamber being returned back to the gear chamber via the return passage.

The lubricant oil having lubricated the bearing is returned back to the gear chamber by means of the circulation section and the oil storage chamber and return passage. Thus, even where a power transmission system, particularly the gear mechanism, of the outboard engine unit is increased in size, the outboard engine unit can smoothly circulate the lubricant oil without increasing the size of the gear chamber in accordance with the increased size of the gear mechanism. By the smooth circulation of the lubricant oil, the inner pressure of the drive shaft chamber and gear chamber can be maintained suitable, so that it is possible to reliably prevent the lubricant oil from flowing out of the drive shaft chamber and gear chamber. Further, by increasing the size of the power transmission system, particularly the gear mechanism, it is possible to increase the rigidity (strength) of the gear mechanism and thereby increase the durability of the power transmission system.

Preferably, the outboard engine unit further comprises: a supply passage having an inlet portion opening to the gear chamber, the supply passage directing the lubricant oil of the gear chamber to the bearing via the inlet portion; a guide protrusion projecting into the gear chamber from a far-side part (or downstream part), in a rotation direction of the gear mechanism, of the inner peripheral surface around and adjacent to the inlet portion of the supply passage, for guiding the lubricant oil of the gear chamber toward the inlet portion of the supply passage. With the guide protrusion guiding the lubricant oil of the gear chamber toward the inlet portion of the supply passage, the lubricant oil can be efficiently guided to the drive shaft chamber to thereby even more efficiently lubricate the bearing.

Preferably, the outboard engine unit further comprises a guide passage communicating between the oil storage chamber and the drive shaft chamber for guiding the lubricant oil, having lubricated the bearing, to the oil storage chamber. Thus, the oil storage chamber is allowed to be in communication with the drive shaft chamber via the guide passage even where the oil storage chamber is located at a considerable distance from the drive shaft chamber. Therefore, the portion for providing therein the oil storage chamber can be chosen from a relatively wide range of choices, which can thus achieve an enhanced design freedom.

Further, preferably, in the outboard engine unit, the drive shaft chamber and the gear chamber are both provided in a gear case, and the oil storage chamber is provided in an unusable portion of the gear case. If the shaft chamber and the gear chamber are increased in size, the gear case would also increase in size. However, because the gear case is a component part immersed in seawater during sliding travel of a watercraft body, it is preferable, in view of resistance of the seawater, that the gear case be not increased in size. Thus, in the outboard engine unit, the gear case, which is formed by casting, has a hollow portion formed in an unusable portion of the gear case, and the hollow portion formed in the unusable portion of the gear case is used as the oil storage chamber. Here, the "unusable portion" is a portion of the gear case that cannot be used as the drive shaft chamber or gear chamber. Because the hollow portion formed in the unusable portion of the gear case is used as the oil storage chamber, the outboard engine unit can maintain a suitable inner pressure of the shaft chamber and the gear chamber without increasing the size of the gear case. Further, the outboard engine unit can provide the oil storage chamber without newly securing a particular portion for providing therein the oil storage chamber and thus without increasing the size of the gear case. Because the size of the gear case does not have to be increased, the outboard engine unit can prevent resistance of seawater from becoming great during sliding travel of the watercraft body, so that an enhanced capability (sliding travel capability) of the outboard engine unit can be secured.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
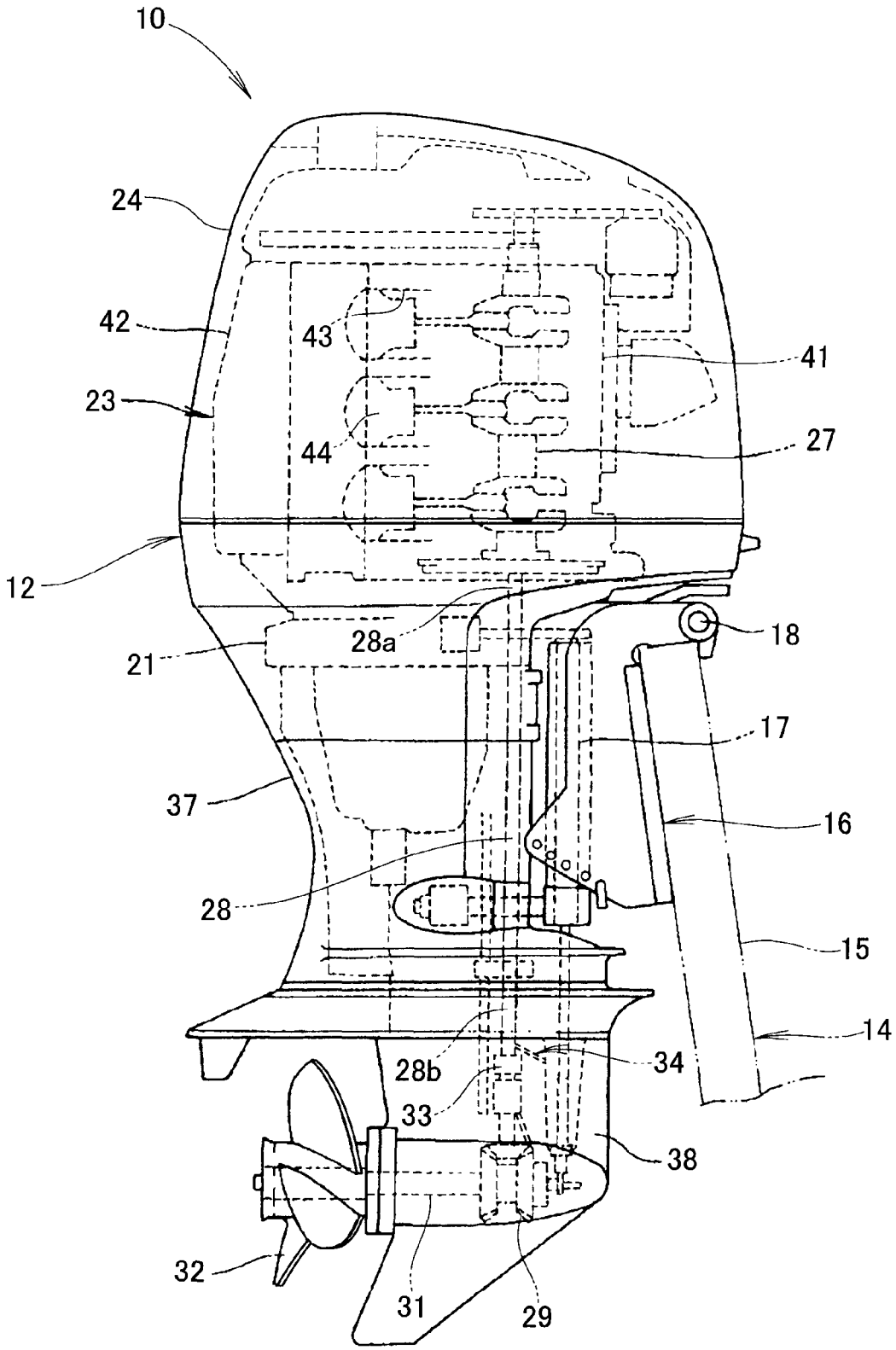
FIG. 1 is a side view illustrating an outboard engine unit.

Reference is now made to FIG. 1 showing in side elevation an outboard engine unit 10 according to an embodiment of the present invention. As shown in FIG. 1, the outboard engine unit 10 comprises an outboard engine unit body 12, and a mounting section 16 provided on the outboard engine unit body 12 and detachably attachable to a hull or body (more specifically, stern 15) of a watercraft. The mounting section 16 includes a swivel shaft 17 about which the outboard engine unit body 12 is pivotable in a left-right or horizontal direction, and a tilt shaft 18 about which the outboard engine unit body 12 is pivotable in an up-down or vertical direction.

The outboard engine unit body 12 includes: a mount case 21 provided on the mounting section 16; an engine 23 mounted on an upper portion of the mount case 21; an engine cover 24 covering the engine 23; a drive shaft 28 having an upper end portion 28*a* connected to a crank shaft 27 of the engine 23; a gear mechanism 29 to which rotation of the engine 23 is transmitted via the drive shaft 28; a propeller 32 to which rotation of the gear mechanism 29 is transmitted via a propeller shaft 31; and a lubrication device 34 for lubricating a taper roller bearing 33 of the drive shaft 28.

The engine 23 includes a cylinder block 41, a head cover 42, the crankshaft 27, a cylinder 43, a piston 44, etc. By activation of the engine 23, the crankshaft 27 rotates, and rotation of the crankshaft 27 is transmitted to the drive shaft 28.

The drive shaft 28 extends downward from the crankshaft 27, and a lower end portion 28*b* of the drive shaft 28 projects beyond a lower end portion of an extension case 37 into a gear case. 38. The propeller shaft 31 is connected to the lower end portion 28*b* of the drive shaft 28 via the gear mechanism 29. The lower end portion 28*b* of the drive shaft 28, the gear mechanism 29 and the propeller shaft 31 are accommodated in the gear case 38.

Figure 2:
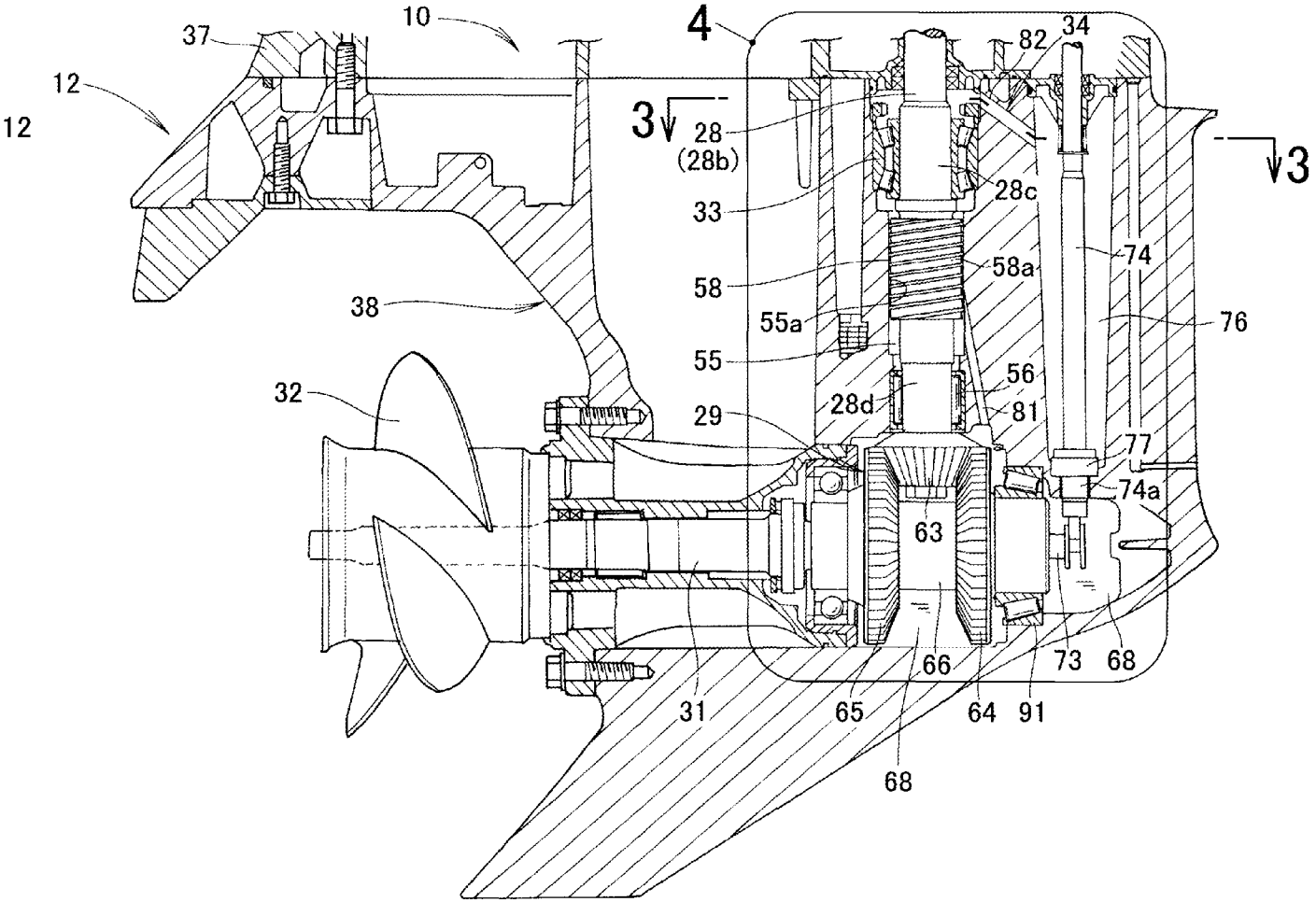
FIG. 2 is a sectional view showing a power transmission system in the outboard engine unit.
Figure 3:
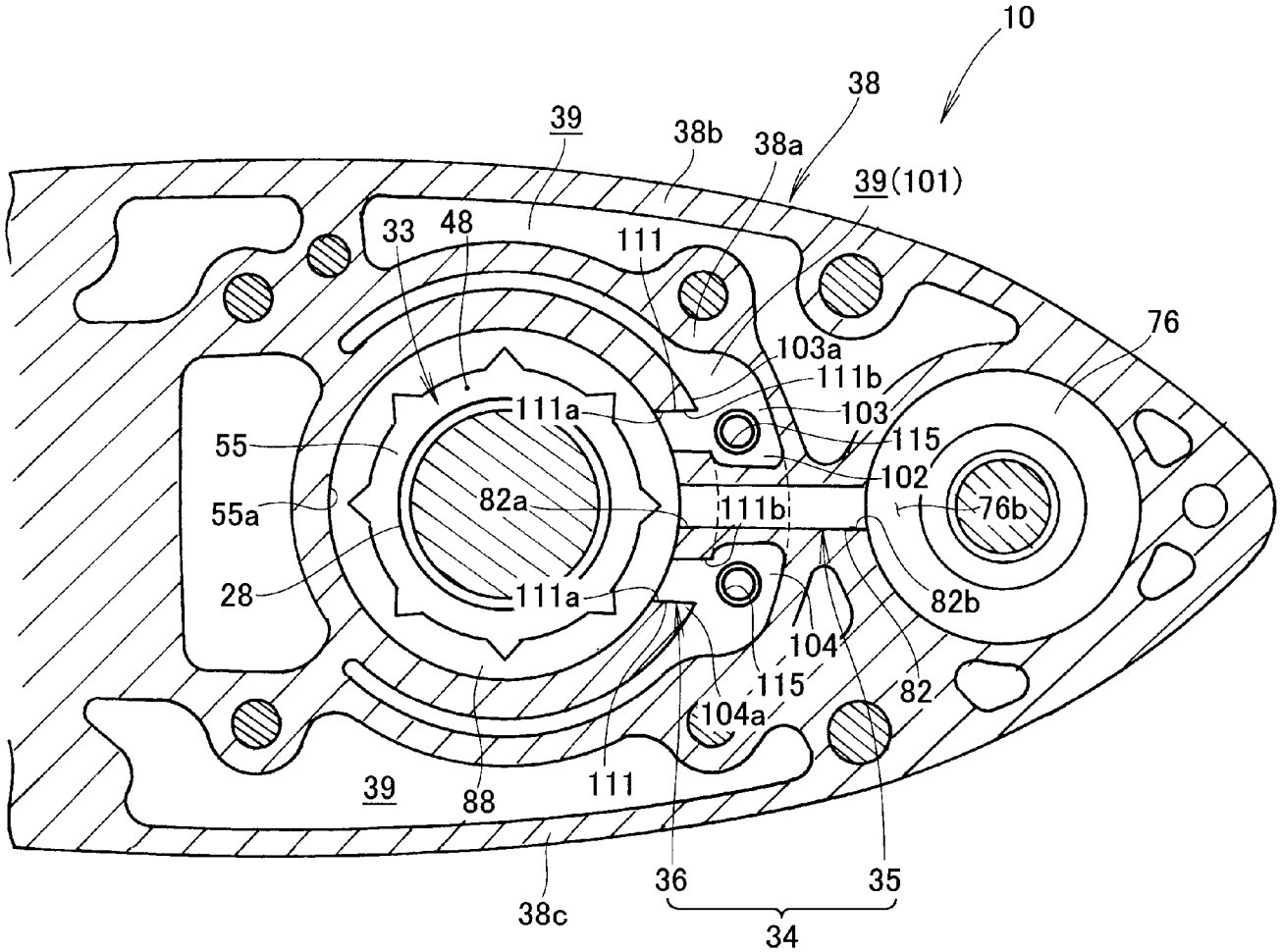
FIG. 3 is a sectional view taken along line 3-3 of FIG. 2.

As shown in FIGS. 2 and 3, the gear case 38, which is normally formed by casting, has hollow portions 39 formed in unusable portions 38*a*, 38*b*, 38*c*, . . . of the gear case 38. Here, the "unusable portions 38*a*, 38*b*, 38*c*, . . . " are portions of the gear case 38 that cannot be used as a drive shaft chamber 55, gear chamber 68, shift chamber 76, or the like. Note that, for simplicity of understanding of the construction of the outboard engine unit 10, the lower end portion 28*b* of the drive shaft 28 will be described also as "drive shaft 28".

Figure 4:
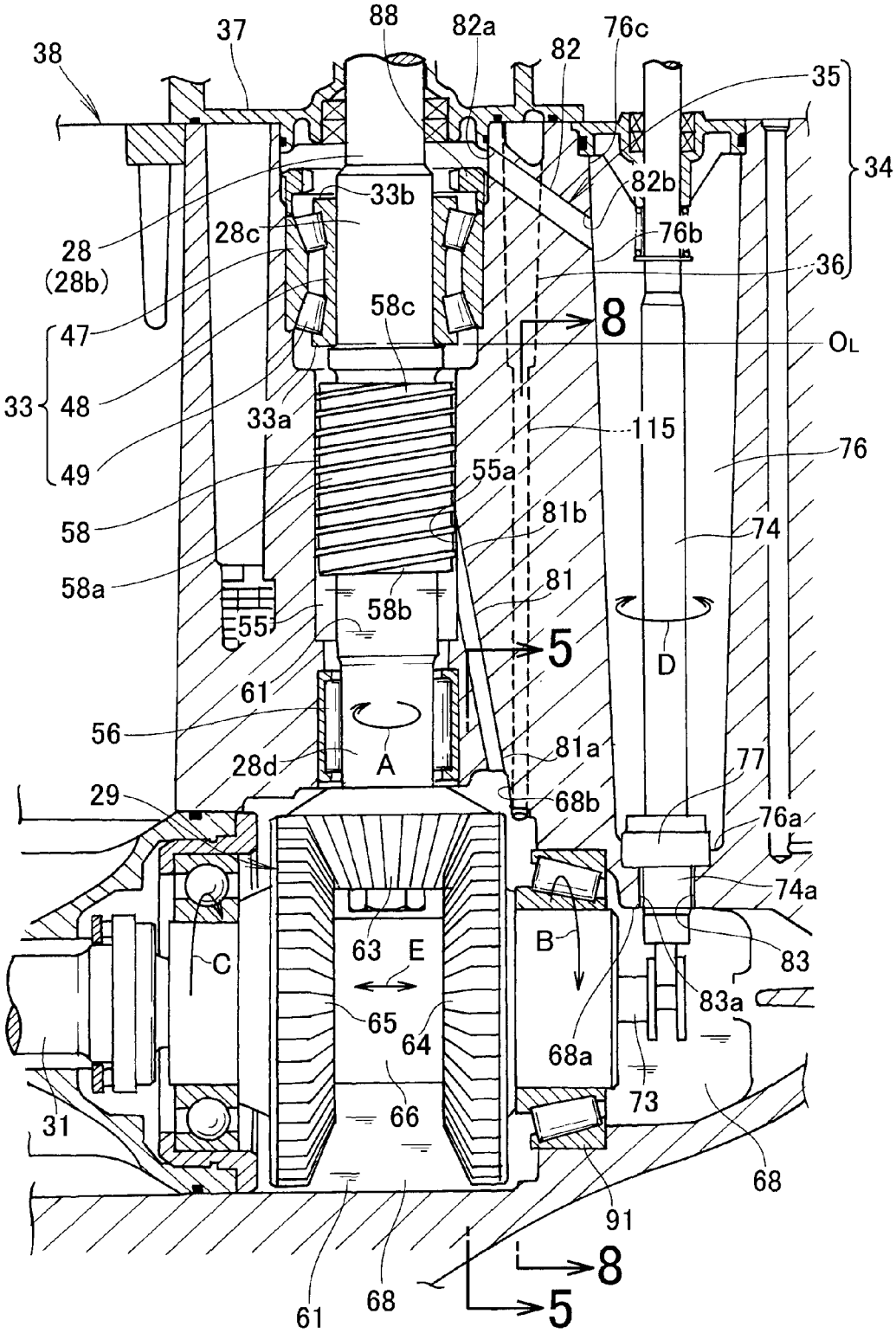
FIG. 4 is an enlarged view of a section depicted at 4 in FIG. 2.

As shown in FIG. 4, the drive shaft 28 has a first support shaft section 28*c* rotatably supported in the drive shaft chamber 55, which is a space provided substantially vertically within the gear case 38, via the taper roller bearing 33, and a second support shaft section 28*d* rotatably supported in the drive shaft chamber 55 via a roller bearing 56. Namely, the drive shaft 28 is accommodated and supported in the drive shaft chamber 55 in a substantially vertical posture by means of the taper roller bearing 33 and roller bearing 56.

The drive shaft 28 has an oil slinger 58 mounted thereon underneath the taper roller bearing 33. Thus, as the drive shaft 28 rotates, the oil slinger 58 rotates together with the drive shaft 28. The oil slinger 58 is accommodated in the drive shaft chamber 55 and has a helical oil groove 58*a* formed in the outer periphery thereof. Thus, by the oil slinger 58 rotating in the aforementioned manner, lubricant oil 61 of the drive shaft chamber 55 can be guided via the helical oil groove 58*a* from a lower end portion 58*b* of the oil slinger 58 to an upper end portion 58*c* of the oil slinger 58. The second support shaft section 28*d* of the drive shaft 28 is connected to the gear mechanism 29.

The gear mechanism 29 is accommodated in the gear chamber 68, and this gear mechanism 29 includes a pinion 63 mounted on the second support section 28*d*, a pair of front and rear bevel gears 64 and 65 meshing with front and rear portions of the pinion 63, and a clutch 66 capable of operatively connecting the front and rear bevel gears 64 and 65 to the propeller shaft 31.

The front bevel gear 64 is rotatably fitted over the propeller shaft 31 in meshing engagement with the front portion of the pinion 63. The rear bevel gear 65 is rotatably fitted over the propeller shaft 31 in meshing engagement with the rear portion of the pinion 63. Further, as the drive shaft 28 (and hence the pinion 63) rotates in a direction of arrow A by activation of the engine 23, the front bevel gear 64 rotates in a predetermined forward direction as indicated by arrow B, while the rear bevel gear 65 rotates in a reverse direction as indicated by arrow C.

The clutch 66 is fitted over the propeller shaft 31 for rotation together with the propeller shaft 31. Because the clutch 66 employed in the instant embodiment is of the same construction as the ordinary dog clutch used in conventionally-known outboard engine units, a detailed description of the clutch 66 is omitted here.

The gear mechanism 29 is accommodated in the gear chamber 68, and the gear chamber 68 is provided in the gear case 38 in communication with an oil chamber (not shown) so that the lubricant oil 61 of the gear chamber 68 is filled in the gear chamber 68, for example, to a position of an oil level OL.

The clutch 66 has a connection section 73 connected to a lower end portion 74*a* of a shift rod 74. The shift rod 74 is accommodated in a shift chamber 76, and the lower end portion 74*a* is rotatably supported in the shift chamber 76 via a ball bearing 77. The shift chamber 76 is formed substantially vertically within the gear case 38 and has a bottom portion 76*a* communicating with a front end portion (more specifically, front top portion) 68*a* of the gear chamber 68. The shift rod 74 is disposed in front of and generally parallel to the drive shaft 28.

An operation rod (not shown) operable by a human operator is provided on an upper end portion of the shift rod 74. The shift rod 74 can be turned as indicated by double-head arrow D in FIG. 4 by the human operator operating the operation rod, so that the clutch 66 can be actuated as indicated by double-head arrow E. By such actuation, the clutch 66 can be switched among a forward rotation state in which the front bevel gear 64 is connected to the propeller shaft 31, a reverse rotation state in which the rear bevel gear 65 is connected to the propeller shaft 31, and a neutral state in which the front and rear bevel gears 64 and 65 are disconnected from the propeller shaft 31.

By the front bevel gear 64 being connected to the propeller shaft 31 through the actuation of the clutch 66 as noted above, rotation of the drive shaft 28 can be transmitted to the propeller shaft 31 via the pinion 63, front bevel gear 64 and clutch 66. Thus, the propeller 32 (see FIG. 2) rotates together with the propeller shaft 31 in the forward direction, so that the water craft body 14 (see FIG. 1) slidingly travels forward.

By the rear bevel gear 65 being connected to the propeller shaft 31 through the actuation of the clutch 66 as noted above, rotation of the drive shaft 28 can be transmitted to the propeller shaft 31 via the pinion 63, rear bevel gear 65 and clutch 66. Thus, the propeller 32 (see FIG. 2) rotates together with the propeller shaft 31 in the reverse direction, so that the water craft body 14 (see FIG. 1) travels rearward.

Further, by the front and rear bevel gears 64 and 65 being disconnected from the propeller shaft 31 through the actuation of the clutch 66, rotation of the drive shaft 28 is prevented from being transmitted to the propeller shaft 31, so that the watercraft body 14 is maintained in a stopped state.

The taper roller bearing 33 of the drive shaft 28 is provided above the oil level OL of the lubricant oil 61. Thus, it is necessary that the lubricant oil 61 be directed to the taper roller bearing 33 via the lubrication device 34, provided within the gear case 38, to lubricate the taper roller bearing 33 with the lubricant oil 61.

The lubrication device 34 includes a main lubricant circulation section 35 for lubricating the taper roller bearing 33 of the drive shaft 28 with the lubricant oil 61, and an auxiliary lubricant circulation section 36. The main lubricant circulation section 35 includes a supply passage 81 communicating between the gear chamber 68 and the drive shaft chamber 55, the drive shaft chamber 55, a shift guide passage 82 communicating between the drive shaft chamber 55 and the shift chamber 76, and a return passage 83 communicating between the shift chamber 76 and the gear chamber 68.

The supply passage 81 has an inlet (lower end portion) 81*a* opening to a central top portion 68*b* of the gear chamber 68, and an outlet (upper end portion) 81*b* opening toward an inner peripheral wall surface 55*a* of the drive shaft chamber 55. The inlet portion 81*a* of the supply passage 81 is located above the front bevel gear 64, and an upper half portion of the outlet portion 81*b* of the supply passage 81 is opposed to the lower end portion 58*b* of the oil slinger 58 while a lower half portion of the outlet portion 81*b* is located below the lower end portion 58*b* of the oil slinger 58.

Figure 5:
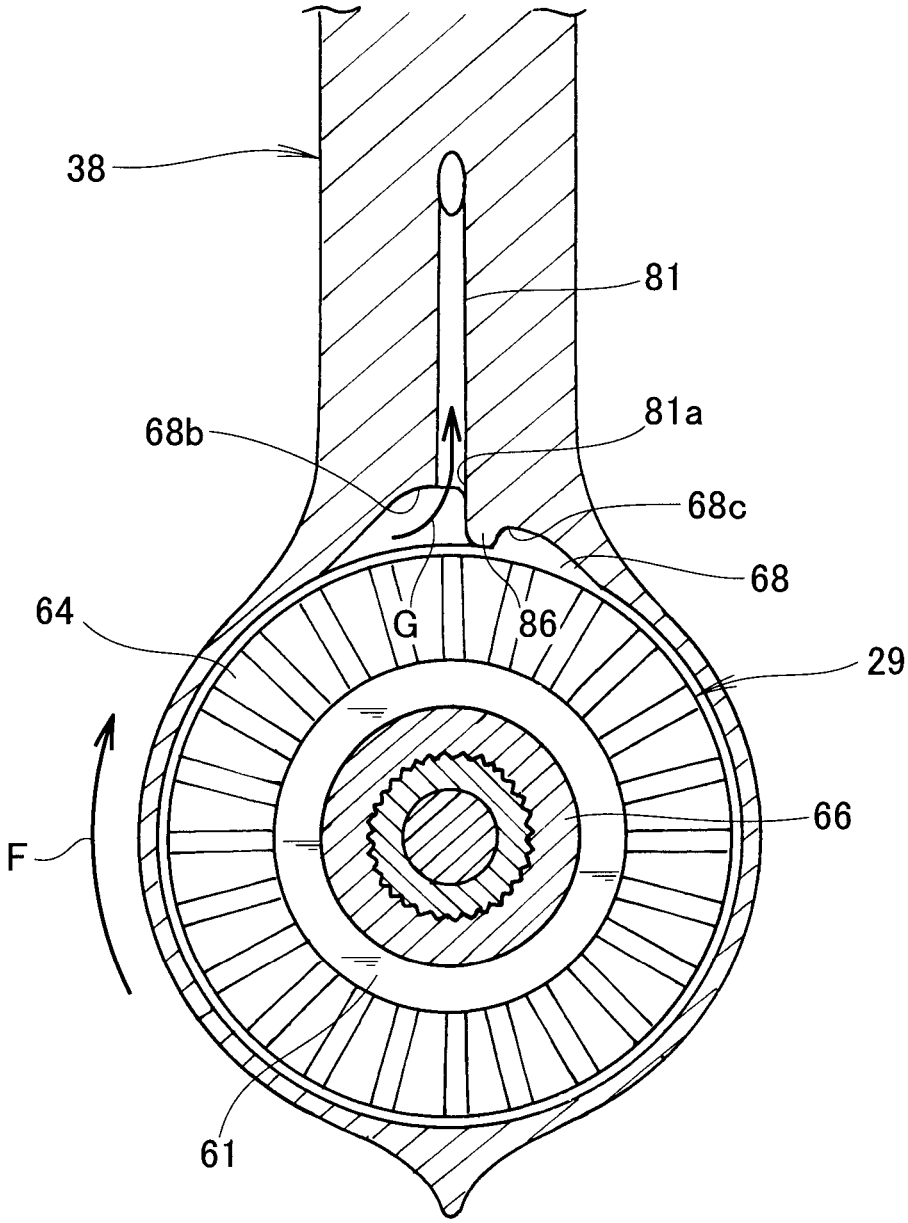
FIG. 5 is a sectional view taken along line 5-5 of FIG. 4.

As shown in FIG. 5 that is a sectional view taken along the 5-5 line of FIG. 4, the central top portion 68*b* of the gear chamber 68 has a guide protrusion 86 provided on a far-side part (downstream part) 68*c*, in a rotation direction (i.e., direction of arrow F or clockwise direction in FIG. 5) of the front bevel gear 64, of the inner peripheral surface of the gear chamber 68 around and adjacent to the inlet portion 81*a*. The guide protrusion 86 projects from the far-side part 68*c* into the gear chamber 68.

Namely, the guide protrusion 86 is located adjacent to the right side of the inlet portion 81*a* in such a manner that it is opposed against the rotation direction of the gear mechanism 29 (more specifically, the front bevel gear 64). In other words, the guide protrusion 86 is provided to operate against the direction where the lubricant oil 61 of the gear chamber 68 is directed by the rotation of the front bevel gear 64.

Thus, the direction of the lubricant oil 61 directed by the rotation of the front bevel gear 64 can be changed by the guide protrusion 86 toward the inlet portion 81*a* as indicated by arrow G. By the guide protrusion 86 thus changing the direction of the lubricant oil 61 toward the inlet portion 81*a*, the lubricant oil 61 can be smoothly guided via the inlet portion 81*a* into the supply passage 81 as indicated by arrow G.

Because the lubricant oil 61 is guided into the supply passage 81 by means of the guide protrusion 86, it can be efficiently directed via the supply passage 81 to the drive shaft chamber 55 (see FIG. 4). Thus, the lubricant oil 61 can be efficiently directed to the taper roller bearing 33 of the drive shaft chamber 55 to appropriately lubricate the roller bearing 33.

As shown in FIGS. 3 and 4, the shift guide passage 82 extends in a downward slope from the drive shaft chamber 55 toward the shift chamber 76. The shift guide passage 82 has an upper end portion 82*a* communicating with the drive shaft chamber 55 (i.e., opening toward the inner peripheral wall surface 55*a* of the drive shaft chamber 55) and a lower end portion 82*b* communicating with the shift chamber 76 (i.e., opening toward an inner peripheral wall surface 76*b* of the shift chamber 76). The upper end portion 82*a* of the shift guide passage 82 is located above a nut 88 that is screwed to the peripheral wall surface 55*a* of the drive shaft chamber 55. In this state, the nut 88 abuts against the upper end of the taper roller bearing 33 to retain the roller bearing 33 in place. The lower end portion 82*b* of the shift guide passage 82 is located near an upper end portion 76*c* of the inner peripheral wall surface 76*b* of the shift chamber 76.

The return passage 83 is a passage communicating between the bottom portion 76*a* of the shift chamber 76 and the front top portion 68*a* of the gear chamber 68. The return passage 83 has a lower end portion 83*a* located near the front side of a taper roller bearing 91 supporting the front bevel gear 64.

With the main lubricant circulation section 35, the lubricant oil 61 of the gear chamber 68 is thrown up by the front bevel gear 64 as the front bevel gear 64 is rotated by the drive shaft 28.

The inlet portion (lower end portion) 81*a* of the supply passage 81 is located immediately above the front bevel gear 64, so that the lubricant oil 61 thrown up by the front bevel gear 64 is allowed to flow into the supply passage 81 via the inlet portion 81*a*. The lubricant oil 61 having flown into the supply passage 81 is directed via the supply passage 81 to the outlet portion (upper end portion) 81*b*, i.e. to the lower end portion 58*b* of the oil slinger 58.

The oil slinger 58 is rotating together with the drive shaft 28. Thus, the lubricant oil 61 having been directed to the lower end portion 58*b* of the oil slinger 58 is guided from the lower end portion 58*b* to the upper end portion 58*c*.

Then, the lubricant oil 61 having been guided to the upper end portion 58*c* of the oil slinger 58 is directed from a lower end portion 33*a* of the taper roller bearing 33 to an upper end portion 33*b* of the taper roller bearing 33 through a gap between an outer race 47 and an inner race 48 of the taper roller bearing 33. Thus, the outer and inner races 47 and 48 and a plurality of rollers 49 of the taper roller bearing 33 are lubricated with the lubricant oil 61.

The lubricant oil 61 having lubricated the taper roller bearing 33 is directed from above the nut 88 into the shift guide passage 82, via which it is directed into the shift chamber 76. The lubricant oil 61 having been directed into the shift chamber 76 as noted above is returned from the bottom portion 76*a* of the shift chamber 76 to the gear chamber 68 by way of the ball bearing 77 and return passage 83.

Figure 6A:
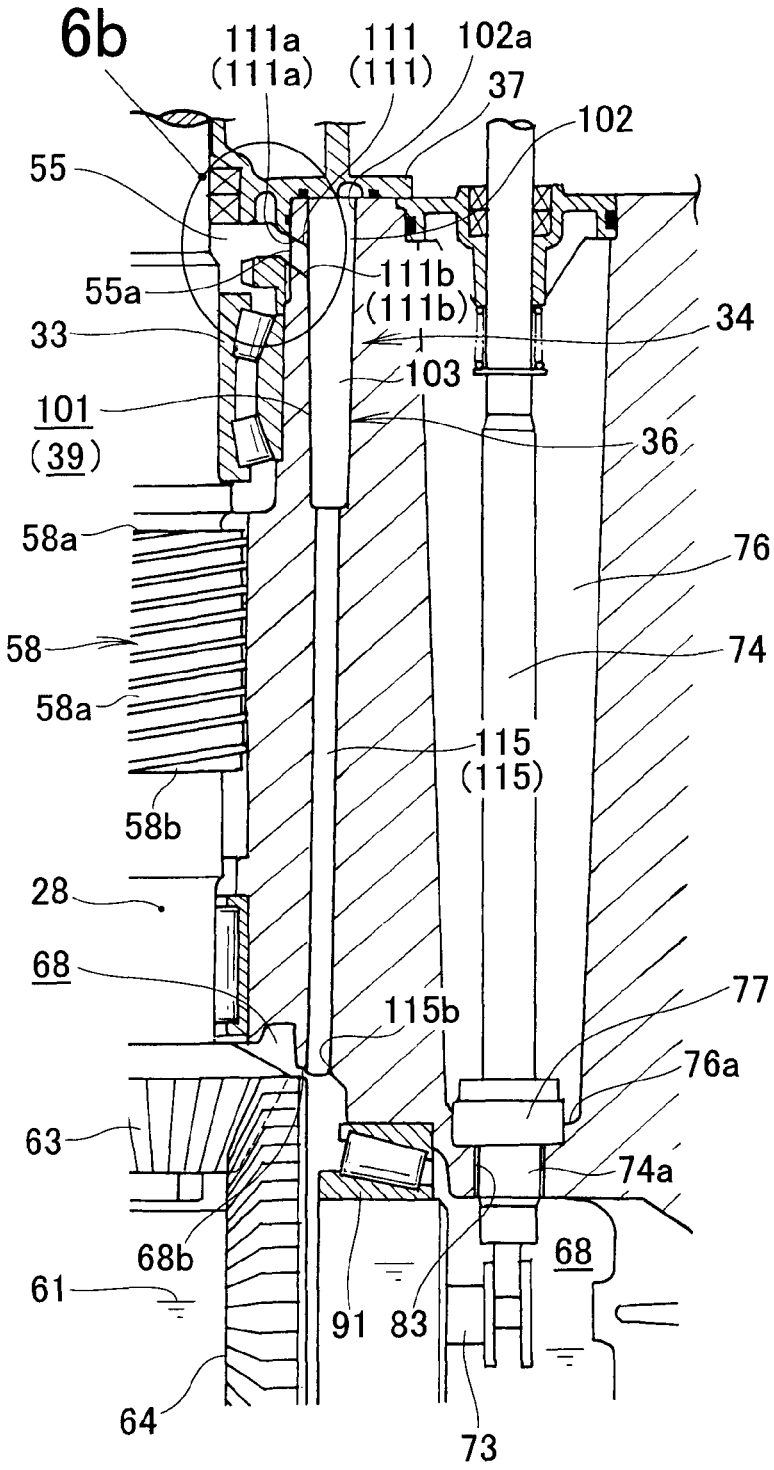
FIG. 6(*a*) is a sectional view of an auxiliary lubricant circulation section in the outboard engine unit, and FIG. 6(*b*) is an enlarged view of a section encircled at 6*b* in FIG. 6(*a*)
Figure 6B:
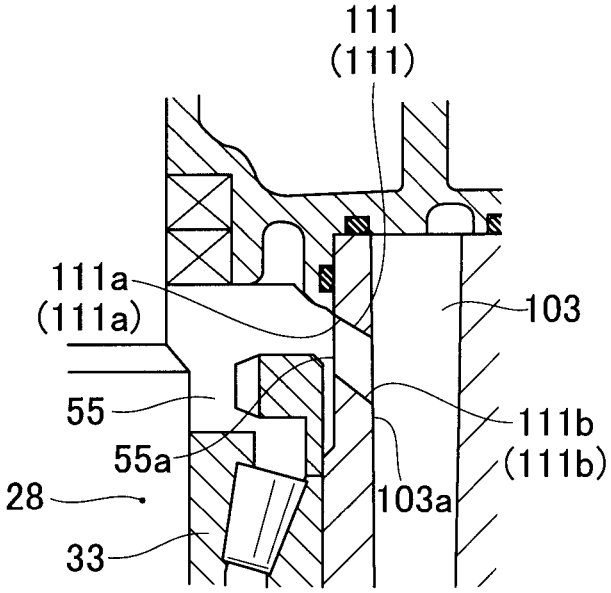

As shown in FIGS. 3 and 6, the auxiliary lubricant circulation section 36 of the lubrication device 34 includes an oil storage chamber 101 provided near the taper roller bearing 33, left and right auxiliary guide passages 111 communicating between the oil storage chamber 101 and the drive shaft chamber 55, and left and right auxiliary return passages 115 communicating between the oil storage chamber 101 and the gear chamber 68.

Figure 7:
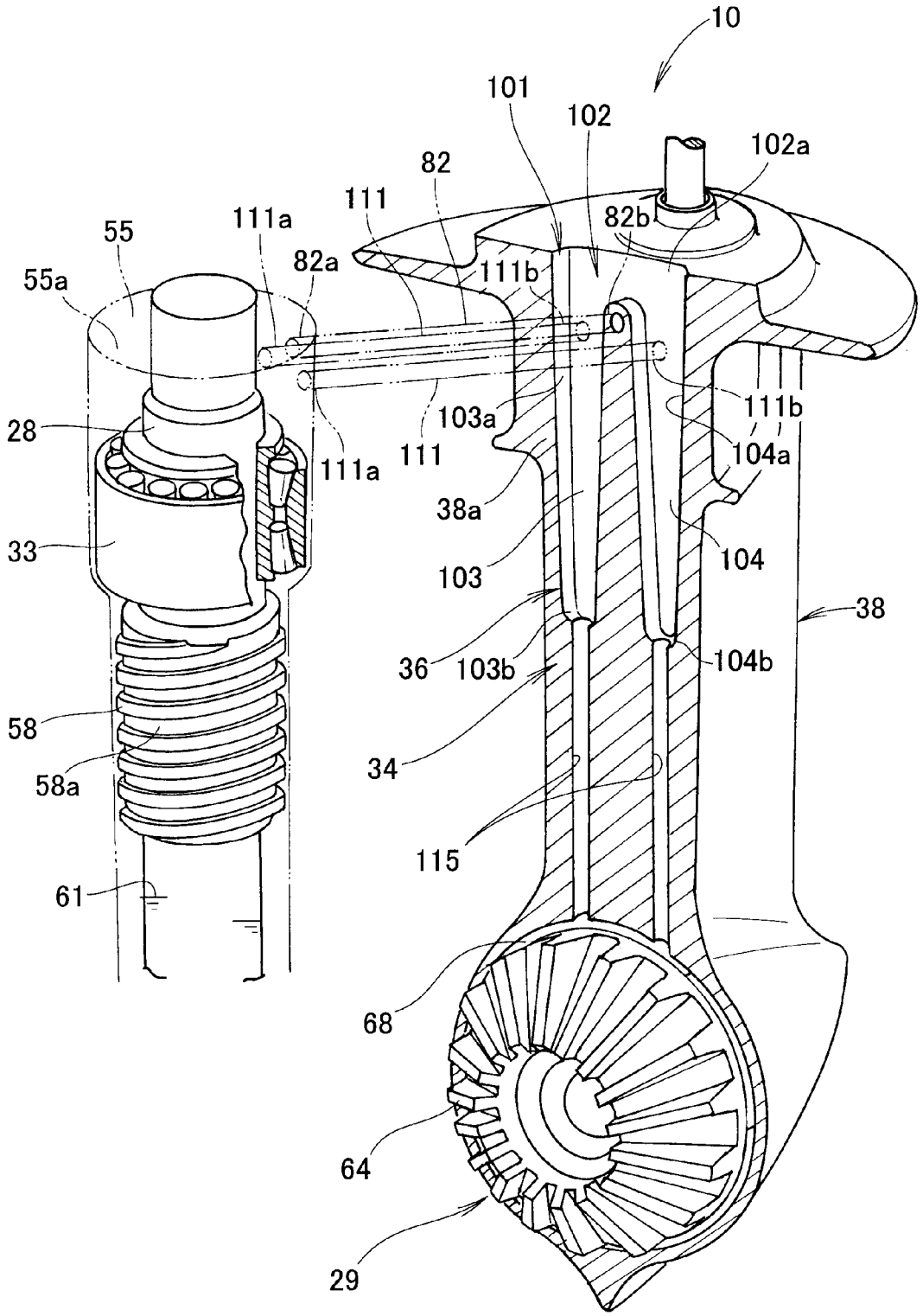
FIG. 7 is a schematic perspective view showing the auxiliary lubricant circulation section in the outboard engine unit.

As shown in FIGS. 3 and 7, the oil storage chamber 101 is provided for receiving the lubricant oil 61 having lubricated the taper roller bearing 33. As noted previously, the gear case 38, which is normally formed by casting, has the hollow portions 39 formed in the unusable portions 38*a*, 38*b*, 38*c*, . . . . Of such hollow portions 39 formed in the unusable portions 38*a*, 38*b*, 38*c*, . . . , the hollow portion 39 in the unusable portion 38*a* is used as the oil storage chamber 101.

Namely, the oil storage chamber 101 is provided in the unusable portion 38*a* of the gear case 38. Therefore, there is no need to newly secure a particular portion in the gear case 38 for providing therein the oil storage chamber 101. In this way, it is possible to provide the oil storage chamber 101 without increasing the size of the gear case 38 and thus prevent resistance of the seawater from becoming great during sliding travel of the watercraft, thereby securing a sufficient capability of the outboard engine unit 10.

The oil storage chamber 101 is formed in a curved shape along the drive shaft chamber 55 as viewed in plan and has a front storage chamber section 102 near a front end portion of the drive shaft chamber 55. The shift guide passage 82 opens to an upper end portion 102*a* of the front storage chamber section 102, and a left front chamber section 103 and a right front chamber section 104 branch downward from near the left and right sides of the shift guide passage 82. The upper end portion 102*a* of the front storage chamber section 102 is sealed with an extension case 37 (see FIG. 6(*a*)).

The branching left and right front chamber sections 103 and 104 extend generally vertically from near the sides of the shift guide passage 82 downward toward the gear chamber 68. The left front chamber section 103 is in communication with the drive shaft chamber 55 via the left auxiliary guide passage 111 of the auxiliary lubricant circulation section 36. The left auxiliary guide passage 111 is located to the left of the shift guide passage 82 and extends along the shift guide passage 82 in a downward slope from the drive shaft chamber 55 toward the left front chamber section 103 (see FIG. 6(*b*)).

The left auxiliary guide passage 111 has an upper end portion 111*a* communicating with the drive shaft chamber 55 (i.e., opening toward the peripheral wall surface 55*a* of the drive shaft chamber 55) and a lower end portion 111*b* communicating with the left front chamber section 103 (i.e., opening to an inner peripheral wall surface 103*a* of the left front chamber section 103).

With the left front chamber section 103 and the drive shaft chamber 55 communicating with each other via the left auxiliary guide passage 111, the lubricant oil 61 having the taper roller bearing 33 is guided to the left front chamber section 103 via the left auxiliary guide passage 111.

Similarly, the right front chamber section 104 is in communication with the drive shaft chamber 55 via the right auxiliary guide passage 111 of the auxiliary lubricant circulation section 36. The right auxiliary guide passage 111 is located to the right of the shift guide passage 82 and extends along the shift guide passage 82 in a downward slope from the drive shaft chamber 55 toward the right front chamber section 104.

The right auxiliary guide passage 111 has an upper end portion 111*a* communicating with the drive shaft chamber 55 (i.e., opening toward the peripheral wall surface 55*a* of the drive shaft chamber 55) and a lower end portion 111*b* communicating with the right front chamber section 104.

With the right front chamber section 104 and the drive shaft chamber 55 communicating with each other via the right auxiliary guide passage 111, the lubricant oil 61 having lubricated the taper roller bearing 33 is guided to the right front chamber section 104 via the right auxiliary guide passage 111.

Thus, the oil storage chamber 101 is allowed to be in communication with the drive shaft chamber 55 via the left and right auxiliary guide passages 111 even where the oil storage chamber 101 is located at a considerable distance from the drive shaft chamber 55. Therefore, the portion for providing therein the oil storage chamber 101 can be chosen from a relatively wide range of choices, which can thus achieve an enhanced design freedom.

Figure 8:
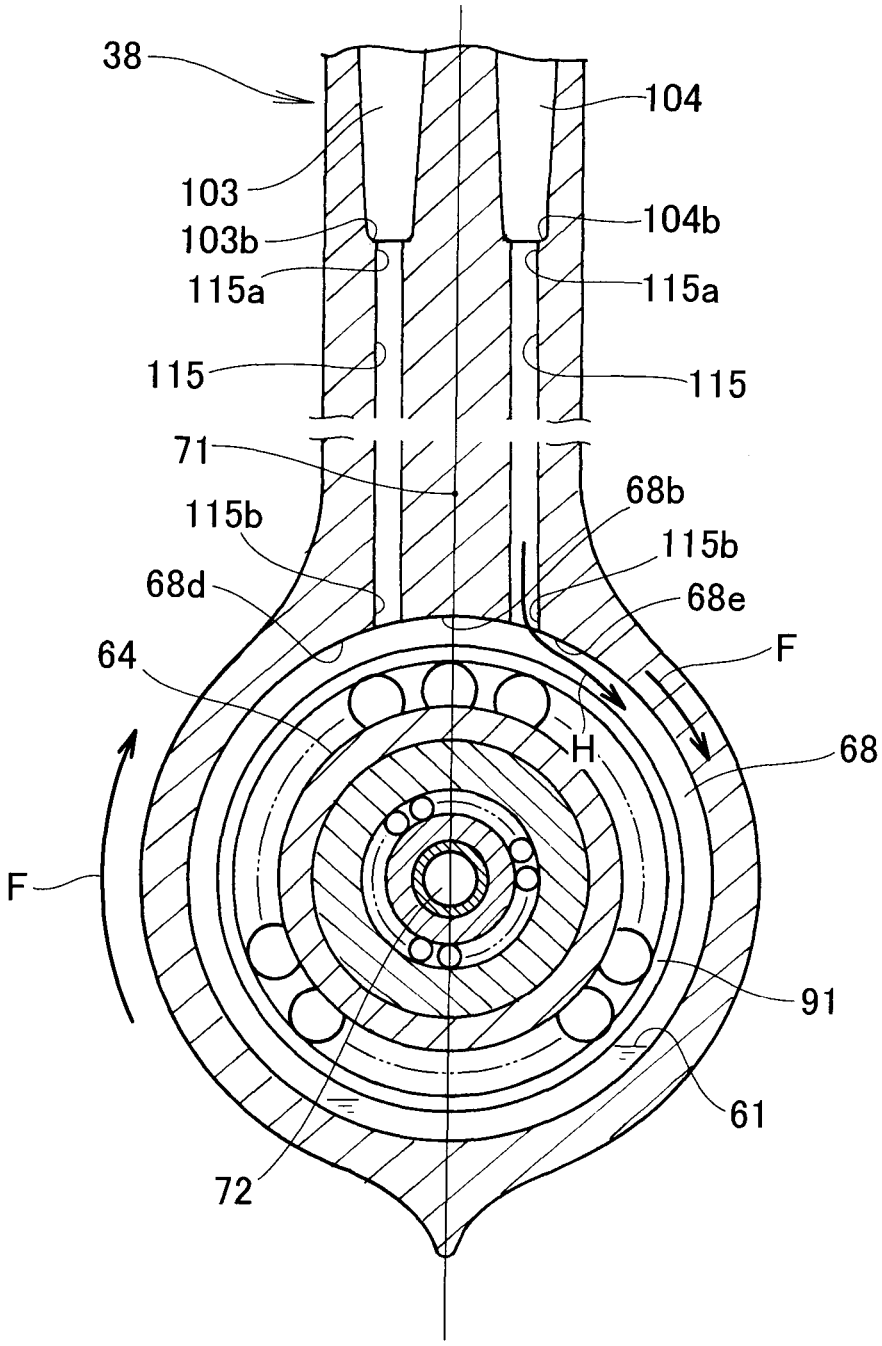
FIG. 8 is a sectional view taken along line 8-8 of FIG. 4.

As shown in FIG. 8 that is a sectional view taken along the 8-8 line of FIG. 4, the left front chamber section 103 is in communication with the gear chamber 68 via the left auxiliary return passage 115 that is provided to the left of a center axis 71 in a generally vertical orientation. The center axis 71 extends vertically from the rotation center 72 of the front bevel gear 64 (see also FIG. 7).

The left auxiliary return passage 115 has an inlet portion 115*a* opening to a bottom portion 103*b* of the left front chamber section 103, and an outlet portion 115*b* opening to a left-side part 68*d* of the central top portion 68*b* of the gear chamber 68 located to the left of the center axis 71. The left-side part 68*d* is located upstream of the center axis 71 in the rotation direction (i.e., direction of arrow F in FIG. 8) of the front bevel gear 64 and taper roller bearing 91. With the outlet portion 115*b* of the left auxiliary return passage 115 opening to the left-side part 68*d* located upstream of the center axis 71, the lubricant oil 61 having been guided to the left front chamber section 103 is returned back to the gear chamber 68 via the left auxiliary return passage 115.

The right front chamber section 104 is in communication with the gear chamber 68 via the right auxiliary return passage 115 that is provided to the right of the center axis 71 in a generally vertical orientation.

The right auxiliary return passage 115 has an inlet portion 115*a* opening to a bottom portion 104*b* of the right front chamber section 104, and an outlet portion 115*b* opening to a right-side part 68*e* of the gear chamber's central top portion 68*b* located to the right of the center axis 71. The right-side part 68*e* is located downstream of the center axis 71 in the rotation direction (i.e., direction of arrow F in FIG. 8) of the front bevel gear 64 and taper roller bearing 91. With the outlet portion 115*b* of the right auxiliary return passage 115 opening to the right-side part 68*e* located downstream of the center axis 71 as noted above, the lubricant oil 61 having been guided to the left front chamber section 103 is returned back to the gear chamber 68 via the right auxiliary return passage 115.

The outlet portion 115*b* of the right auxiliary return passage 115 opens to the right-side part 68*e* located downstream the center axis 71 in the rotation direction (i.e., direction of arrow F in FIG. 8) of the front bevel gear 64 and taper roller bearing 91. The right-side part 68*e* is formed in an arcuate shape extending downward from the center axis 71 in the direction of arrow F.

The aforementioned direction of arrow F is the rotation direction of the front bevel gear 64 and taper roller bearing 91. Thus, the lubricant oil having been directed from the outlet portion 115*b* of the right auxiliary return passage 115 to the gear chamber 68 can be smoothly directed, through the rotation of the front bevel gear 64 and taper roller bearing 91, to flow downward along the wall surface of the right-side 68*e* or far-side part 68*c*. In this way, the lubricant oil 61 of the right auxiliary return passage 115 can be smoothly directed from the outlet portion 115*b* of the right auxiliary return passage 115 to the gear chamber 68 as indicated by arrow H.

With the auxiliary lubricant circulation section 36, as shown in FIG. 7, the lubricant oil 61 having lubricated the taper roller bearing 33 is guided to the oil storage chamber 101 via the left and right auxiliary guide passages 111. Then, the lubricant oil 61 having been thus guided to the oil storage chamber 101 is returned back to the gear chamber 68 via the left and right auxiliary return passages 115.

Namely, by the provision of the auxiliary lubricant circulation section 36 in addition to the main lubricant circulation section 35 shown in FIG. 3, the lubricant oil 61 having lubricated the taper roller bearing 33 can be smoothly and promptly returned back to the gear chamber 68.

Thus, even where the power transmission system, particularly the gear mechanism 29, is increased in size, the instant embodiment can smoothly circulate the lubricant oil 61 without increasing the size of the gear chamber 68 in accordance with the increased size of the gear mechanism 29. By the smooth circulation of the lubricant oil 61, the inner pressure of the drive shaft chamber 55 and gear chamber 68 can be maintained suitable, so that it is possible to reliably prevent the lubricant oil 61 from flowing out of the drive shaft chamber 55 and gear chamber 68.

Further, increasing the size of the power transmission system, particularly the gear mechanism 29, it is possible to increase the rigidity (strength) of the gear mechanism 29 and thereby increase the durability of the power transmission system.

Further, the shaft chamber 55 and the gear chamber 68 are formed in the gear case 38. Thus, if the shaft chamber 55 and the gear chamber 68 are increased in size, the gear case 38 would increase in size as in the relevant prior art. However, because the gear case 38 is a component part immersed in the seawater during sliding travel of the watercraft body 14 (see FIG. 1), it is preferable, in view of resistance of the seawater, that the gear case 38 be not increased in size.

Therefore, in the instant embodiment of the outboard engine unit 10, the hollow portion 39 in the unusable portion 38*a* of the gear case 38 (see FIG. 3) is used as the oil storage chamber 101. In this way, the instant embodiment can maintain suitable the inner pressure of the shaft chamber 55 and the gear chamber 68 without increasing the size of the gear case 38. Because the instant embodiment does not have to increase the size of the gear case 38, it is possible to prevent resistance of the seawater from becoming great during sliding travel of the watercraft body 14 (see FIG. 1), so that an enhanced capability (sliding travel capability) of the outboard engine unit 10 can be secured.

Figure 9:
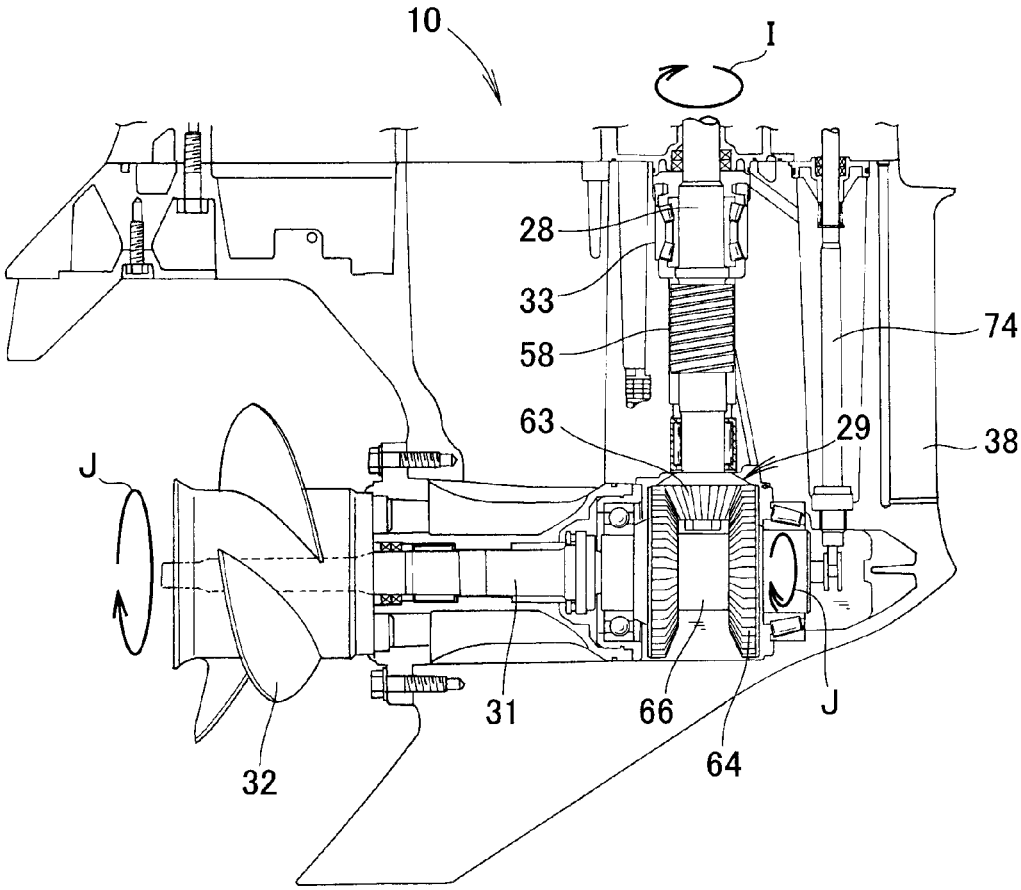
FIG. 9 is a view illustrating a manner in which a propeller is rotated in a forward direction by means of the power transmission mechanism in the embodiment of the outboard engine unit.

The following describe, with reference to FIGS. 9 to 11, a manner in which the taper roller bearing 33 is lubricated by the lubrication device 34. First, with reference to FIG. 9, a description will be given about a manner in which the watercraft body 14 is caused to slidingly travel forward by means of the outboard engine unit 10. As shown in FIG. 9, the drive shaft 28 rotates as indicated by arrow I by activation of the engine 23. By the pinion 63 rotates together with the drive shaft 28, the front bevel gear 64 rotates as indicated by arrow J. In this state, the shift rod 74 is turned, via the operation rod, to actuate the clutch 66, so that the front bevel gear 64 is connected to the propeller shaft 31 by means of the clutch. Then, by the propeller 32 being rotated by the propeller shaft 31 as indicated by arrow J, the watercraft body 14 slidingly travels forward.

Next, with reference to FIGS. 10A and 10B, a description will be given about a manner in which the lubricant oil 61 is circulated by the lubricant circulation section 35 of the lubrication device 34.

As the front bevel gear 64 rotates as indicated by arrow J, the lubricant oil 61 of the gear chamber 68 is guided or directed, by the rotation of the bevel gear 64, toward the guide protrusion 86 as indicated by arrow J. By being guided toward the guide protrusion 86, the lubricant oil 61 is directed by the guide protrusion 86 to flow toward the inlet portion 81*a* of the supply passage 81. In this way, the lubricant oil 61 can be efficiently guided to the supply passage 81 via the inlet portion 81*a*.

Figure 10B:
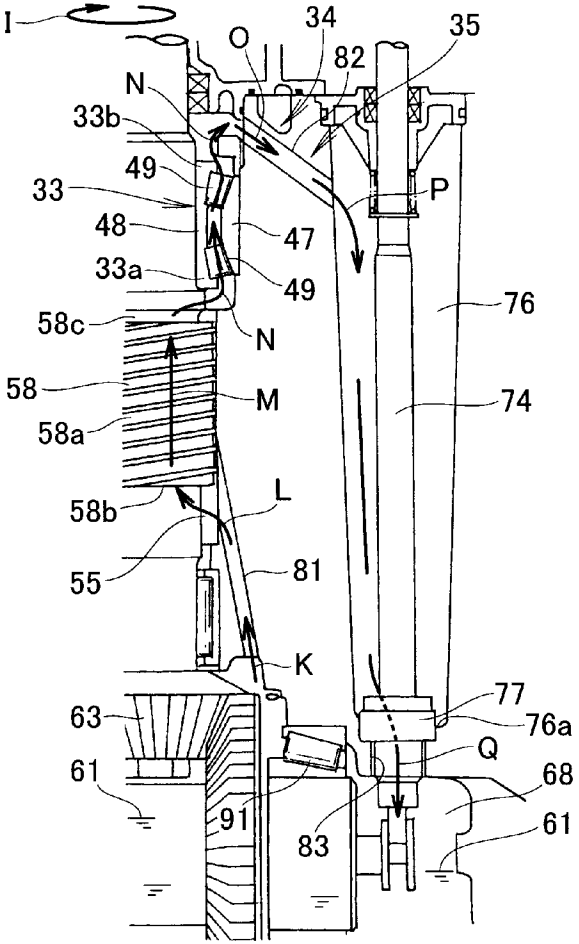
FIGS. 10A and 10B are views illustrating a manner in which a taper roller bearing is lubricated by a lubricant circulation section in the embodiment of the outboard engine unit.
Figure 10A:
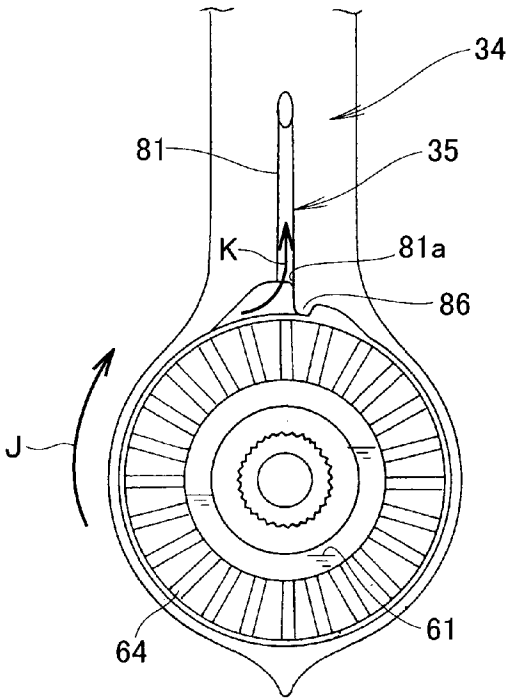

As shown in FIG. 10B, the lubricant oil 61 having been guided to the supply passage 81 is directed, via the supply passage 81, to the drive shaft chamber 55 (i.e., to the lower end portion 58*b* of the oil slinger 58) as indicated by arrow L.

The oil slinger 58 is rotating together with the drive shaft 28 as indicated by arrow I. Thus, the lubricant oil 61 having been directed to the lower end portion 58*b* of the oil slinger 58 is guided upward from the lower end portion 58*b* to the upper end portion 58*c*, as indicated by arrow M.

Then, the lubricant oil 61 having been guided to the upper end portion 58*c* of the oil slinger 58 is directed from the lower end portion 33*a* of the taper roller bearing 33 to the upper end portion 33*b* of the taper roller bearing 33 through the gap between the outer race 47 and the inner race 48 of the taper roller bearing 33, as indicated by arrow N. Thus, the outer and inner races 47 and 48 and the plurality of rollers 49, and hence the taper roller bearing 33, is lubricated with the lubricant oil 61.

The lubricant oil 61 having lubricated the taper roller bearing 33 is directed into the shift guide passage 82 as indicated by arrow O, via which it is directed into the shift chamber 76 as indicated by arrow P. The lubricant oil 61 having been directed into the shift chamber 76 as noted above is returned from the bottom portion 76*a* of the shift chamber 76 back to the gear chamber 68 by way of the ball bearing 77 and return passage 83, as indicated by arrow Q.

Figure 11B:
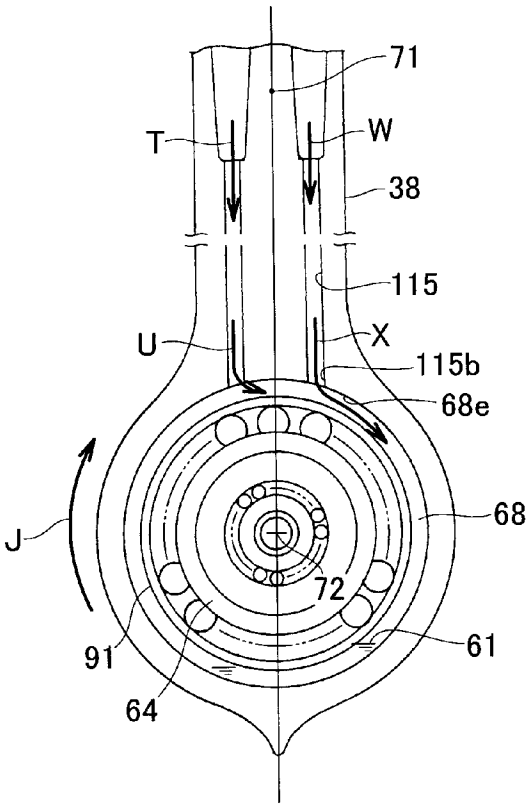
FIGS. 11A and 11B are views illustrating a manner in which lubricant oil having lubricated the taper roller bearing is circulated by the auxiliary lubricant circulation section.
Figure 11A:
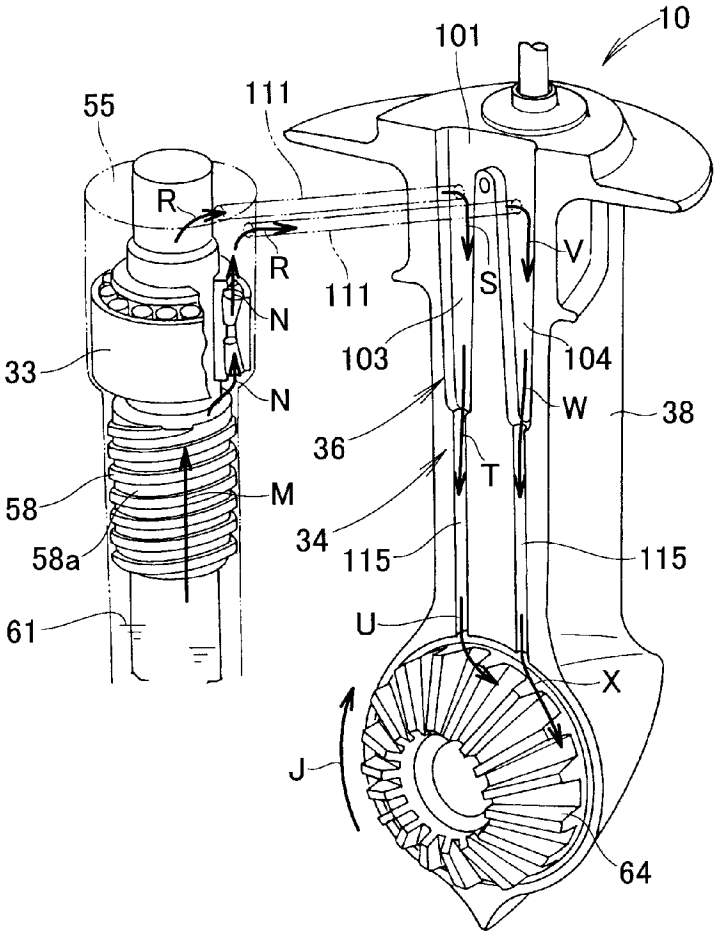

Next, with reference to FIGS. 11A and 11B, a description will be given about a manner in which the lubricant oil 61 is circulated by the auxiliary guide passage 36 of the lubrication device 34. As shown in FIG. 11A, the lubricant oil 61 having lubricated the taper roller bearing 33 is guided to the left and right auxiliary guide passages 111 as indicated by arrow R.

Then, the lubricant oil 61 having been guided to the left auxiliary guide passage 111 is directed, via the guide passage 111, to the left front chamber section 103 (oil storage chamber 101) as indicated by arrow S, via which it is directed to the left auxiliary return passage 115 as indicated by arrow T. The lubricant oil 61 having been directed to the left auxiliary return passage 115 is returned, via the return passage 115, back to the gear chamber 68 as indicated by arrow U.

Meanwhile, the lubricant oil 61 having been guided to the right auxiliary guide passage 111 is directed, via the guide passage 111, to the right front chamber section 104 (oil storage chamber 101) as indicated by arrow V, via which it is directed to the right auxiliary return passage 115 as indicated by arrow W. The lubricant oil 61 having been directed to the right auxiliary return passage 115 is returned, via the return passage 115, back to the gear chamber 68 as indicated by arrow X.

The front bevel gear 64 (FIG. 11A) and the taper roller bearing 91 are being rotated as indicated by arrow J. Thus, the lubricant oil 61 having been directed via the outlet portion 115*b* of the right auxiliary return passage 115 directed, through the rotation of the front bevel gear 64 and taper roller bearing 91, to flow downward along the wall surface of the right-side 68*e* or far-side part 68*c*. As noted above, the right-side part 68*e* is formed in an arcuate shape extending downward from the center axis 71 in the direction of arrow X (i.e., in a direction where the lubricant oil 61 is directed). In this way, the lubricant oil 61 of the right auxiliary return passage 115 can be smoothly directed from the outlet portion 115*b* of the right auxiliary return passage 115 to the gear chamber 68.

By the lubricant oil 61 having lubricated the taper roller bearing 33 being returned back to the gear case 68 via the lubricant circulation section 35 and auxiliary lubricant circulation section 36 as shown and described in FIGS. 9 to 11, the instant embodiment can smoothly and promptly circulate the lubricant oil 61. Because of such smooth circulation of the lubricant oil 61, the inner pressure of the drive shaft chamber 55 and gear chamber 68 can be maintained suitable, so that the instant embodiment can reliably prevent the lubricant oil 61 from flowing out of the drive shaft chamber 55 and gear chamber 68. Thus, even where the power transmission system, particularly the gear mechanism 29, is increased in size, the instant embodiment does not have to increase the size of the gear chamber 68 in accordance with the increased size of the gear mechanism 29.

Further, in the instant embodiment of the outboard engine unit 10, the hollow portion 39 formed in the unusable portion 38*a* of the gear case 38 (see FIG. 3) is used as the oil storage chamber 101. Thus, the instant embodiment can maintain suitable the inner pressure of the shaft chamber 55 and the gear chamber 68 without increasing the size of the gear case 38. Because the instant embodiment does not have to increase the size of the gear case 38, it is possible to prevent resistance of the seawater from becoming great during sliding travel of the watercraft body 14, so that an enhanced capability (sliding travel capability) of the outboard engine unit 10 can be secured. Furthermore, because the power transmission system, particularly the gear mechanism 29, is increased in size, the rigidity (strength) of the gear mechanism 29 can be increased, so that the durability of the power transmission system can be increased.

It should be appreciated that the outboard engine unit 10 of the present invention is not limited to the above-described preferred embodiment and can be modified variously. For example, whereas the preferred embodiment has been described above in relation to the case where the auxiliary lubricant circulation section 36 includes the left and right auxiliary guide passages 111, the present invention is not so limited, and the number of the auxiliary guide passages 111 is not limited to two and may be chosen as desired.

Further, whereas the preferred embodiment has been described above in relation to the case where the taper roller bearing 33 is lubricated by the lubrication device 34, any other bearing than the taper roller bearing, such as a ball bearing may be employed and lubricated by the lubrication device 34.

Furthermore, the shapes and constructions of the outboard engine unit 10, engine 23, crankshaft 27, drive shaft 28, gear mechanism 29, propeller shaft 31, taper roller bearing 33, lubrication device 34, main lubricant circulation section 35, auxiliary lubricant circulation section 36, gear case 38, drive shaft chamber 55, gear chamber 68, supply passage 81, guide protrusion 86, oil storage chamber 101, auxiliary guide passages 111, auxiliary return passages 115, etc. are not limited to those illustratively shown and described above and may be modified as necessary.

The basic principles of the present invention are well suited for application to outboard engine units which include a drive shaft connected to an engine and rotatably supported in a drive shaft chamber via a bearing, and in which rotation of the drive shaft is transmitted to a propeller shaft via a gear mechanism.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An outboard engine unit, comprising:

a drive shaft connected to a crankshaft of an engine, said drive shaft being rotatably supported in a drive shaft chamber via a bearing;

a gear mechanism for transmitting rotation of said drive shaft to a propeller shaft accommodated in a gear chamber;

a circulation section which directs lubricant oil in said gear chamber to said bearing and which returns the lubricant oil having lubricated the bearing back to the gear chamber, said circulation section directing the lubricant oil to said bearing and returning the lubricant oil to said gear chamber by rotation of said gear mechanism;

an oil storage chamber in communication with said circulation section, said oil storage chamber receiving the lubricant oil having lubricated said bearing;

a return passage communicating said oil storage chamber with said gear chamber, wherein the lubricant oil guided to the oil storage chamber is returned to said gear chamber via said return passage;

a supply passage having an inlet portion opening to said gear chamber, the supply passage directing the lubricant oil of said gear chamber to said bearing via the inlet portion; and a guide protrusion projecting into said gear chamber from a far-side part, in a rotation direction of the gear mechanism, of an inner peripheral surface around the inlet portion of the supply passage, the guide protrusion guiding the lubricant oil of the gear chamber toward said inlet portion of said supply passage.

2. The outboard engine unit according to claim 1, further comprising a guide passage communicating between said oil storage chamber and said drive shaft chamber for guiding the lubricant oil having lubricated said bearing to the oil storage chamber.

3. The outboard engine unit according to claim 1, wherein said drive shaft chamber and said gear chamber are provided in a gear case, and wherein said oil storage chamber is provided in an unused portion of said gear case.

* * * * *